United States Patent [19]

Smith et al.

[11] 4,326,317

[45] Apr. 27, 1982

[54] DECONTAMINATION APPARATUS

[75] Inventors: Edward H. Smith, Brave, Pa.; Thomas H. Dent, Bolingbrook, Ill.; Robert T. Marchese, Penn Hills Township, Allegheny County, Pa.

[73] Assignee: Westinghouse Electric Corp., Pittsburgh, Pa.

[21] Appl. No.: 85,444

[22] Filed: Oct. 16, 1979

[51] Int. Cl.[3] ..... B08B 9/02

[52] U.S. Cl. ..... 15/302; 15/315; 15/395; 15/104.1 R

[58] Field of Search ..... 15/104.1 R, 302, 315, 15/387, 395

[56] References Cited

U.S. PATENT DOCUMENTS

| | | | |
|---|---|---|---|
| 2,090,174 | 8/1937 | Albright | 64/2 |
| 2,232,358 | 2/1941 | Baerer | 15/395 X |
| 2,313,042 | 3/1943 | Bay | 15/104.1 R |
| 2,355,733 | 8/1944 | Johnson et al. | 15/104.1 R X |
| 3,056,700 | 10/1962 | Osterlin | 134/17 |
| 3,871,139 | 3/1975 | Rands | 51/334 |

FOREIGN PATENT DOCUMENTS

| | | |
|---|---|---|
| 1112107 | 5/1968 | United Kingdom . |

*Primary Examiner*—Chris K. Moore

*Attorney, Agent, or Firm*—L. A. DePaul; Z. L. Dermer

[57] ABSTRACT

The decontamination apparatus comprises a rotatable hone capable of being inserted into a heat exchange tube of a steam generator for removing contamination from the inside of the heat exchange tubes. The apparatus also comprises means for advancing and retracting the hone and means for removing contamination from the apparatus as the apparatus is withdrawn from the steam generator.

8 Claims, 9 Drawing Figures

DECONTAMINATION APPARATUS

CROSS-REFERENCE TO RELATED APPLICATION

This application is related to copending application Ser. No. 85,445, entitled "Decontamination Method" filed herewith in the name of T. H. Dent et al. and assigned to the same assignee.

BACKGROUND OF THE INVENTION

This invention relates to decontamination apparatus and more particularly to apparatus for decontaminating heat exchange tubes in a nuclear steam generator.

A typical nuclear steam generator comprises a vertically oriented shell, a plurality of U-shaped tubes disposed in the shell so as to form a tube bundle, a tubesheet for supporting the tubes at the ends opposite the U-like curvature, and a dividing plate that cooperates with the tubesheet forming a primary fluid inlet plenum at one end of the tube bundle and a primary fluid outlet plenum at the other end of the tube bundle. The primary fluid having been heated by circulation through the nuclear reactor core enters the steam generator through the primary fluid inlet plenum. From the primary fluid inlet plenum, the primary fluid flows upwardly through first openings in the U-tubes near the tubesheet which supports the tubes, through the U-tube curvature, downwardly through second openings in the U-tubes near the tubesheet, and into the primary fluid outlet plenum. At the same time, a secondary fluid known as feedwater, is circulated around the U-tubes in heat transfer relationship therewith, thereby transferring heat from the primary fluid in the tubes to the secondary fluid surrounding the tubes causing a portion of the secondary fluid to be converted to steam. Since the primary fluid contains radioactive particles and is isolated from the secondary fluid by the U-tube walls and the tubesheet, it is important that the U-tubes and tubesheet be maintained defectfree so that no breaks will occur in the U-tubes or in the welds between the U-tubes and the tubesheet, thus preventing contamination of the secondary fluid by the primary fluid.

Occasionally, it is necessary to inspect or repair the U-tubes or the tubesheet welds by way of access through the primary fluid inlet and outlet plena. For this purpose, manways are provided in the vertical shell so that working personnel may enter the inlet and outlet plena to perform operations on the U-tubes and tubesheet. However, since the primary fluid which is generally water contains radioactive particles, the inlet and outlet plena become radioactive, which thereby limits the time that working personnel may be present therein. In addition, since the primary fluid is conducted through the U-tubes, the U-tubes also become contaminated. Accordingly, it would be advantageous to be able to perform operations on the U-tubes and tubesheet without being exposed to high levels of radiation. Consequently, it is important to decontaminate the inlet and outlet plena together with a portion of the U-tubes so that working personnel may enter the inlet and outlet plena of the nuclear steam generator to perform operations thereon.

Therefore, what is needed is apparatus that is capable of decontaminating the U-tubes so as to reduce the radiation level in the inlet and outlet plena of the nuclear steam generator so that work may be performed thereon.

SUMMARY OF THE INVENTION

The decontamination apparatus comprises a rotatable hone capable of being disposed within a heat exchange tube of a nuclear steam generator. The rotatable hone is equipped with a fluid supply means for directing a fluid such as water against the inside of the heat exchange tubes during rotation of the hone so as to cool the hone and carry away the contaminated particles that have been removed. The decontamination apparatus also comprises means for inserting and removing the hone from the heat exchange tubes and for remotely advancing or retracting the hone through the length of the heat exchange tubes. Cleaning means are also provided for cleaning contamination from the apparatus as the apparatus is removed from the nuclear steam generator.

BRIEF DESCRIPTION OF THE DRAWINGS

While the specification concludes with claims particularly pointing out and distinctly claiming the subject matter of the invention it is believed the invention will be better understood from the following description taken in conjunction with the accompanying drawings wherein:

DESCRIPTION OF THE PREFERRED EMBODIMENT

In a tube-type steam generator, a tubesheet supports a bundle of heat transfer tubes. The invention described herein provides a rotatable hone that is capable of remotely decontaminating the heat transfer tubes in a nuclear steam generator.

Figure 1:
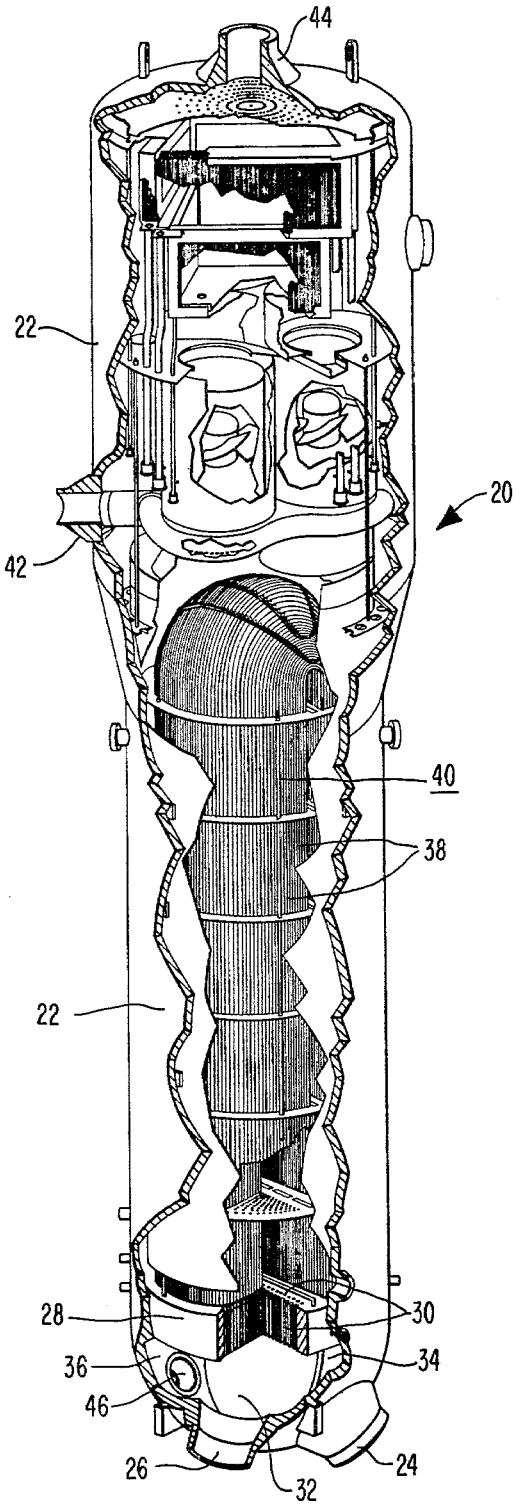
FIG. 1 is a partial cross-sectional view in elevation of a typical steam generator.

Referring to FIG. 1, a nuclear steam generator referred to generally as 20, comprises an outer shell 22 with a primary fluid inlet nozzle 24 and a primary fluid outlet nozzle 26 attached thereto near its lower end. A generally cylindrical tubesheet 28 having tube holes 30 therein is also attached to outer shell 22 near its lower end. A dividing plate 32 attached to both tubesheet 28 and outer shell 22 defines a primary fluid inlet plenum 34 and a primary fluid outlet plenum 36 in the lower end of the steam generator as is well understood in the art. Tubes 38 which are heat transfer tubes shaped in a U-like curvature are disposed within outer shell 22 and attached to tubesheet 28 by means of tube holes 30. Tubes 38, which may number about 3,500 form a tube bundle 40. In addition, a secondary inlet nozzle 42 is disposed on outer shell 22 for providing secondary fluid such as water while steam outlet nozzle 44 is attached to the top of outer shell 22. In operation, the primary fluid which may be water having been heated by circulation through the nuclear reactor core enters steam generator 20 through primary fluid inlet nozzle 24 and flows into primary fluid inlet plenum 34. From primary fluid inlet plenum 34, the primary fluid flows upwardly through tubes 38, through tubesheet 28, up through the U-shaped curvature of tubes 38, down through tubes 38 and into the primary fluid outlet plenum 36, where the primary fluid exits the steam generator through primary fluid outlet nozzle 26. While flowing through tubes 38, heat is transferred from the primary fluid to the secondary fluid which surrounds the tubes 38, causing the secondary fluid to vaporize. The resulting steam then exits the steam generator through steam outlet nozzle 44. On occasion, it is necessary to inspect or repair tubes 38 or the welds between the tubes 38 and the tubesheet 28 to assure that the primary fluid, which may contain radioactive particles, remains isolated from the secondary fluid. Therefore, manways 46 are provided in outer shell 22 to provide access to both primary fluid inlet plenum 34 and primary fluid outlet plenum 36 so that access may be had to the entire tubesheet 28.

Figure 2:
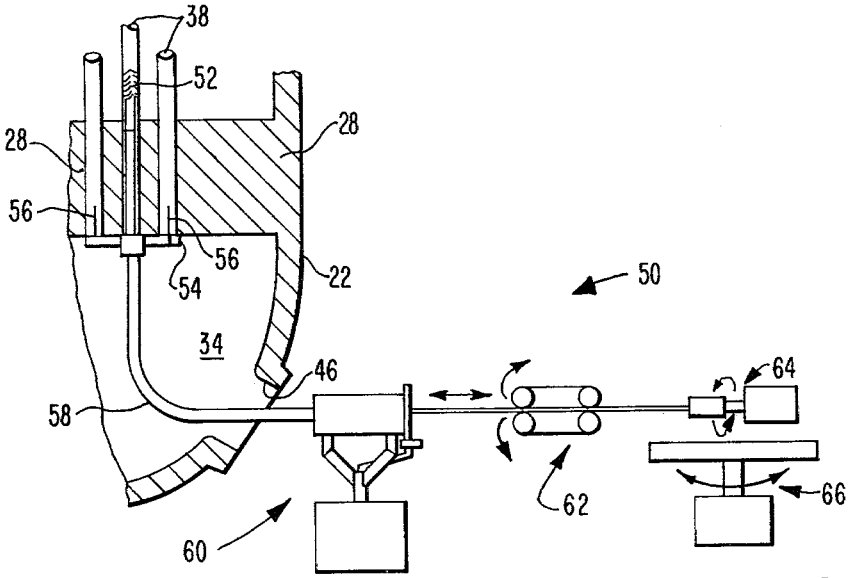
FIG. 2 is a diagram of the decontamination apparatus shown in relation to a typical steam generator.

Referring now to FIG. 2, the decontamination apparatus is referred to generally as 50 and comprises a rotatable hone 52 capable of being disposed within tubes 38. Rotatable hone 52 has an attachment mechanism 54 disposed around it for guiding the rotatable hone in relationship to tubesheet 28. Attachment mechanism 54 has a plurality of camlocks 56 attached thereto for being disposed in tubes 38 so as to support attachment mechanism 54 from tubesheet 28. Camlocks 56 may be chosen from those well known in the art. As an alternative to the use of attachment mechanism 54, rotatable hone 52 may be supported and guided by remote handling devices (not shown). Decontamination apparatus 50 also comprises a first flexible conduit 58 attached to attachment mechanism 54 and capable of being extended through manway 46 to cleaning mechanism 60. Cleaning mechanism 60 is provided for removing contamination from rotatable hone 52 as rotatable hone 52 is removed from steam generator 20. Decontamination apparatus 50 also comprises advancement mechanism 62 for advancing and withdrawing rotatable hone 52. Advancement mechanism 62 may comprise a tandem set of motorized rubber belts in contact with rotatable hone 52 for moving rotatable hone 52 in a desired direction. In addition decontamination apparatus 50 comprises drive mechanism 64 and cable holding apparatus 66. Drive mechanism 64 serves as the mechanism to rotate rotatable hone 52 while cable holding apparatus 66 provides a mechanism for winding and unwinding the cable of decontamination apparatus 50.

Figure 3:
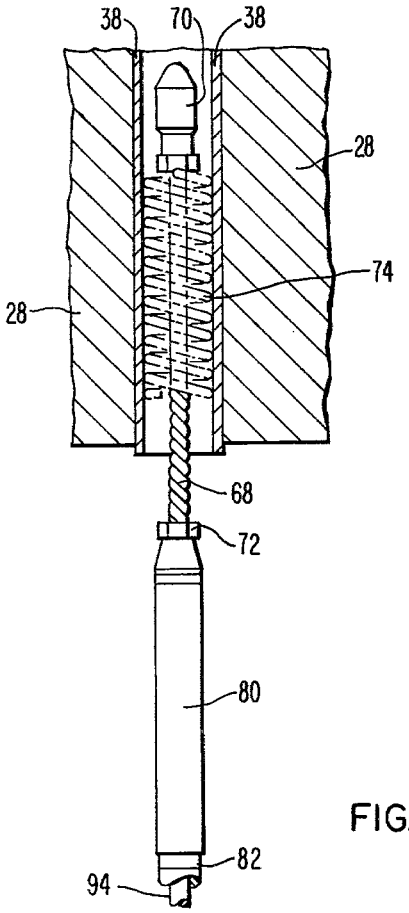
FIG. 3 is a partial cross-sectional view of the rotatable hone disposed within a heat exchange tube of a nuclear steam generator.
Figure 4:
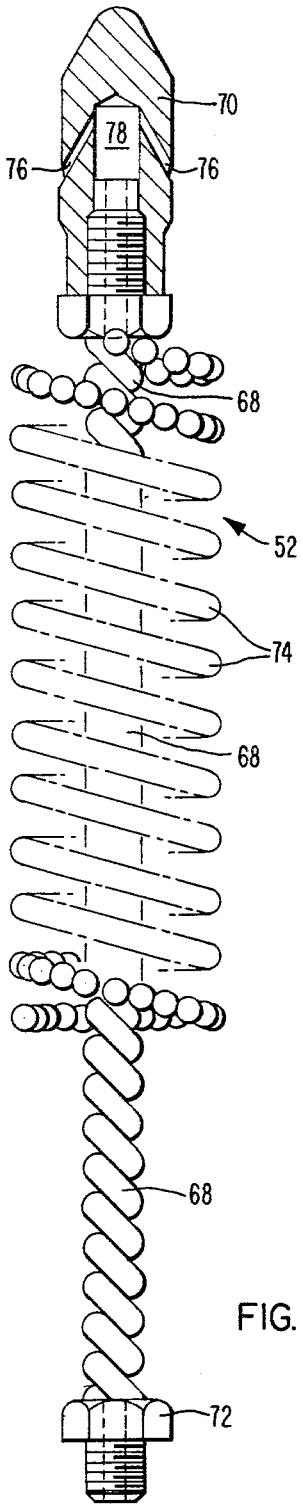
FIG. 4 is an enlargement of the rotatable hone.
Figure 5:
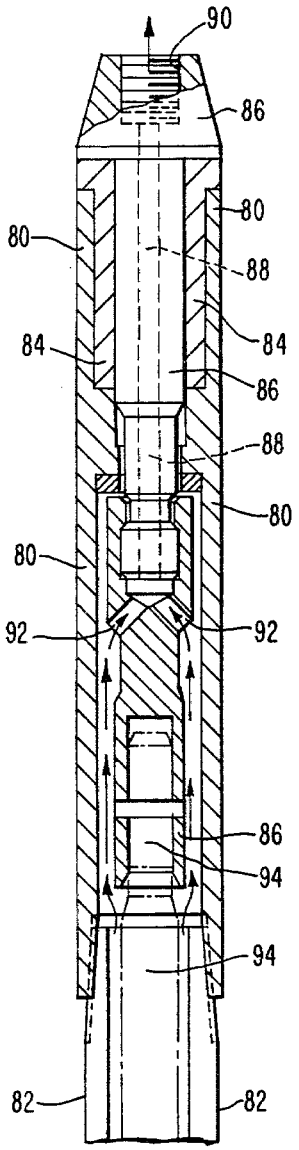
FIG. 5 is a detailed cross-sectional view of the rotatable hone apparatus.

Referring now to FIGS. 3, 4, and 5, rotatable hone 52 comprises helical wound tubing 68 capable of conducting a fluid therethrough. A nozzle 70 is attached to one end of helical wound tubing 68 while a screw fitting 72 is connected to the other end thereof. A spirally wound brush 74 is disposed on helical wound tubing 68 between screw fittings 72 and nozzle 70 for contacting the inside of tubes 38 and removing contaminants therefrom when rotatable hone 52 is rotated. Brush 74 may be chosen from those well known in the art of honing. Brush 74 is chosen such that it is capable of removing a thin layer of contaminated metal from the insides of tubes 38 to thereby reduce the contamination of the tubes 38. Nozzle 70 has a plurality of channels 76 disposed therein for conducting the fluid from nozzle plenum 78 and directing the fluid toward the inside of tubes 38 to thus lubricate brush 74 and to flush the contaminated particles that have been removed by brush 74. Channel 76 may have a diameter of approximately 1/32 inch and may be arranged at approximately between 20° to 40° angle with respect to the longitudinal axis of nozzle 70 and preferably at approximately 30°. As rotatable hone 52 is rotated and as brush 74 contacts the inside of tubes 38 a fluid such as water is conducted through helical wound tubing 68, into nozzle plenum 78, and out through channel 76 into contact with the inside of tube 38 and brush 74. In this manner a thin layer of metal is removed from the inside of tubes 38 and flushed through first flexible conduit 58 to cleaning mechanism 60. The fluid conducted through helical wound tubing 68 serves to not only flush away the contaminated particles, but it also serves to lubricate and cool brush 74.

Still referring to FIGS. 3, 4, and 5, rotatable hone 52 also comprises an outer member 80 that is attached to second flexible conduit 82 in a fluid-tight manner and is capable of being disposed in first flexible conduit 58. A bushing 84 is disposed in outer member 80 and has inner member 86 rotatably disposed therein. Inner member 86 has a bore 88 therethrough for conducting a fluid. Screw fitting 72 is capable of being attached to inner member 86 by means of threads 90 in inner member 86. Inner member 86 also has a plurality of passages 92 in its lower end for a allowing the fluid to enter inner member 86 and to flow through bore 88 into helical wound tubing 68. At its lower end, inner member 86 is firmly attached to cable 94 which is attached to drive mechanism 64 located outside the steam generator for rotating inner member 86 and helical wound tubing 68 thus rotating brush 74 of rotatable hone 52. Cable 94 is disposed in second flexible conduit 82 so as to allow a fluid such as water to be conducted through second flexible conduit 82 and into the annulus between inner member 86 and outer member 80 so as to force the fluid through passages 92 and through bore 88. The fluid is conducted through bore 88, through helical wound tubing 68, and into nozzle plenum 78. From nozzle plenum 78, the fluid is forced through channels 76 of nozzle 70 and into contact with brush 74 and the inner surface of tubes 38. The fluid entrains the contaminants that are removed by brush 74 and carries the contaminants to the bottom of tube 38 where they are carried away through first flexible conduit 58 to cleaning mechanism 60.

Referring now to FIGS. 6–9, cleaning mechanism 60 comprises a housing 96 with flexible conduit 58 attached thereto at one end. Second flexible conduit 82 and cable 94 are arranged to slide through first flexible conduit 58, through a central passage in housing 96, and into attachment with drive mechanism 64. A first fluid return chamber 98 is defined in housing 96 and in fluid communication with first flexible conduit 58 so that the fluid that is being returned by first flexible conduit 58 flows into first fluid return chamber 98 and into drain piping 100. From drain piping 100, the fluid is conducted to either a waste disposal treatment facility or to a recirculation facility chosen from those well known in the art. A spray chamber 102 is also defined within housing 96 for spraying a second fluid which may also be water onto second flexible conduit 82 for removing contamination from second flexible conduit 82. Spray chamber 102 comprises an outer sleeve 104 which may be a substantially cylindrical member and an inner sleeve 106 disposed within outer sleeve 104. Inner sleeve 106 has holes disposed therein for conducting the second fluid therethrough. An inlet port 108 is attached to the outside of outer sleeve 104 for conducting the second fluid into the annulus defined between outer sleeve 104 and inner sleeve 106. From the annulus defined between inner sleeve 106 and outer sleeve 104, the second fluid is conducted therethrough and out of the holes in inner sleeve 106. In this manner, the second fluid is sprayed against second flexible conduit 82 for removing the contamination therefrom. A spray water return chamber 110 is also disposed within housing 96 and connected to drain piping 100. Spray water return chamber 110 serves to collect the spray of the second fluid and conduct the second fluid into drain piping 100 thereby removing contaminants from second flexible conduit 82. A wiper section 112 is attached to the end of housing 96 such that second flexible conduit 82 passes therethrough. Wiper section 112 comprises a plurality of buffing cloths 114 which are disposed within wiper section 112 and in contact with second flexible conduit 82 for removing fluid and contaminants from second flexible conduit 82. The excess fluid that is collected by buffing cloths 114 is allowed to drip into drip pan 116 and from there allowed to flow into drain piping 100. Therefore, it can be seen that cleaning mechanism 60 serves to conduct the first fluid from first flexible conduit 58 to drain piping 100 and serves to clean second flexible conduit 82.

Figure 6:
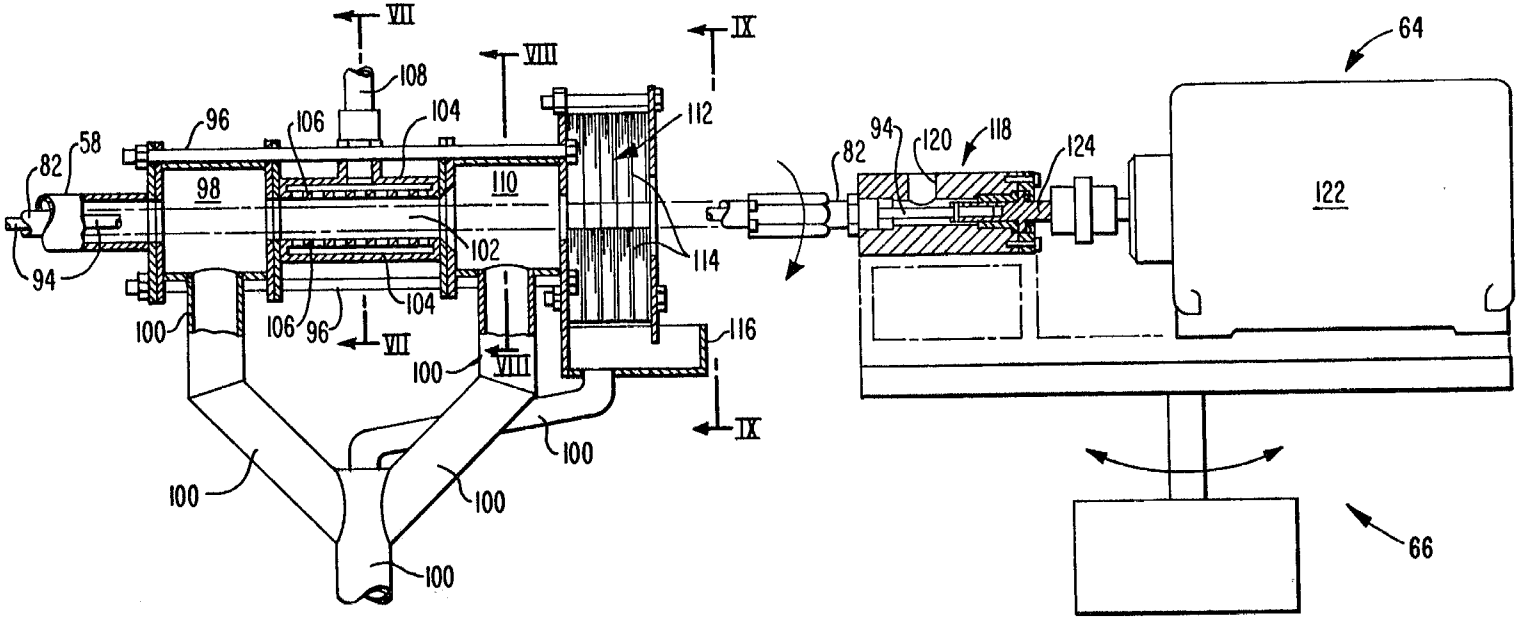
FIG. 6 is a partial cross-sectional view in elevation of the cleaning apparatus and drive mechanism.
Figure 7:
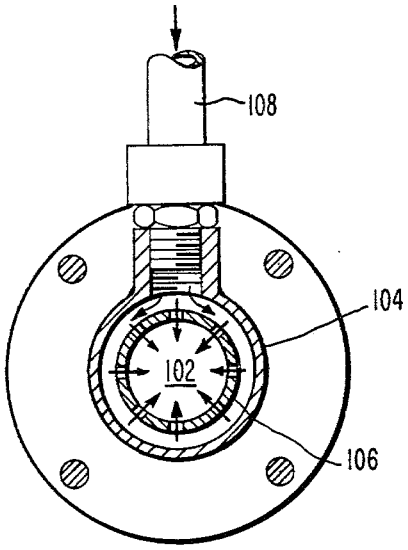
FIG. 7 is a view along line VII—VII of FIG. 6.
Figure 8:
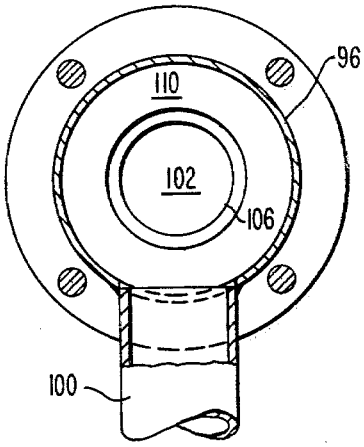
FIG. 8 is a view along line VIII—VIII of FIG. 6.
Figure 9:
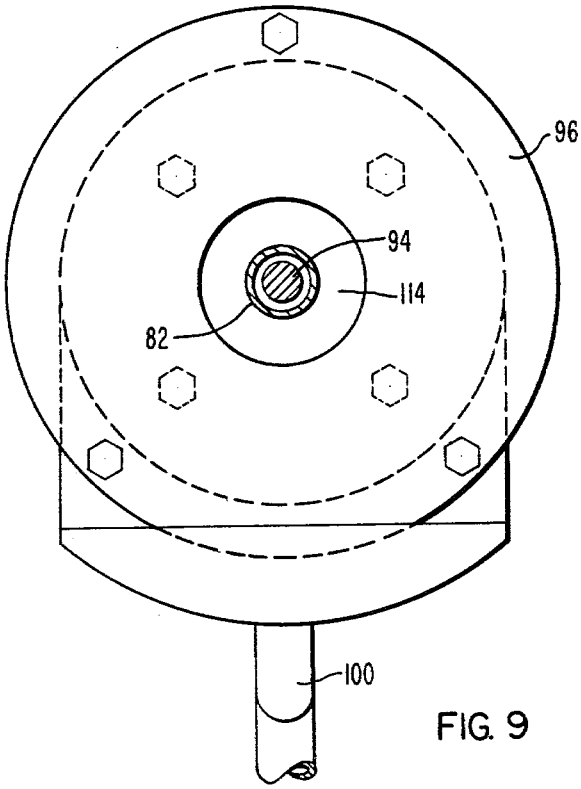
FIG. 9 is a view along line IX—IX of FIG. 6.

Referring now to FIG. 6, drive mechanism 64 comprises a chuck 118 having an opening 120 therein. Cable 94 is rotatably disposed within chuck 118 and attached to motor 122 by means of a rotatable connector 124. Motor 122 may be a 0.5 horsepower motor chosen from those well known in the art and is provided for rotating cable 94 and rotatable hone 52. The second flexible conduit 82 is also attached to chuck 118. Opening 120 is provided for conducting a fluid into chuck 118 and into second flexible conduit 82 while cable 94 is being rotated by motor 122. Thus, chuck 118 provides a mechanism whereby cable 94 can be rotated without second flexible conduit 82 being rotated thereby allowing a fluid to be conducted through second flexible conduit 82 and around cable 94. Motor 122 serves to rotate cable 94 which in turn rotates rotatable hone 52 thus removing the contamination from the inside of tubes 38. Drive mechanism 64 is supported on cable holding apparatus 66. Cable holding apparatus 66 may be a rotatable platform or a take-up wheel capable of rotating so as to accommodate the excess cable 94 and excess second flexible conduit 82 under the influence of advancement mechanism 62. Thus, drive mechanism 64, the excess of cable 94, and the excess of second flexible conduit 82 are stored on cable holding apparatus 66 such that when advancement mechanism 62 advances cable 94 and second flexible conduit 82, cable holding apparatus 66 rotates to allow such advancement. On the other hand, when advancement mechanism 62 retracts second flexible conduit 82 and cable 94, cable holding apparatus 66 rotates in the opposite direction, thus storing the excess cable and conduit.

OPERATION

When it becomes necessary to inspect or repair steam generator 20, steam generator 20 is deactivated and drained of its primary fluid. Next, personnel enter steam generator 20 through manways 46 to position decontamination apparatus 50 in relationship thereto so as to decontaminate the steam generator. Attachment mechanism 54 is arranged near tubesheet 28 so that camlocks 56 are inserted into tubes 38. Camlocks 56 are then activated thereby supporting attachment mechanism 54 from tubesheet 28. In this manner first flexible conduit 58 is attached to a particular tube 38 in a fluid-tight manner.

Once first flexible conduit 58 has been connected to the selected tube 38, rotatable hone 52 is then inserted into first flexible conduit 58 and advanced therethrough by means of advancement mechanism 62. When rotatable hone 52 has reached the desired location within tube 38, drive mechanism 64 is activated which results in motor 122 rotating cable 94 and rotatable hone 52 at the desired angular speed. At the same time, a first fluid which may be water is conducted under a pressure of between approximately 1800 psi to 2000 psi through opening 120 and into chuck 118. From chuck 118, the first fluid is conducted through second flexible conduit 82 and into inner member 86. From inner member 86 the first fluid is then conducted through helical wound tubing 68 and out through channels 76 of nozzle 70. The first fluid contacts brush 74 and the inside of tubes 38 as brush 74 rotates in contact with the inside of tube 38. The action of brush 74 removes a thin layer of contaminated metal from the inside of tube 38 which thereby lowers the radiation level of tube 38. The first fluid entrains the contaminated metal that has been removed and carries it to the bottom of tube 38 where the first fluid enters first flexible conduit 58. First flexible conduit 58 carries the first fluid with contaminants entrained therein to cleaning mechanism 60 and into drain piping 100.

Advancement mechanism 62 moves rotatable hone 52 through tube 38 at a linear rate slow enough to ensure proper decontamination but at a fast enough rate to prevent degradation of tube 38. The rate at which rotatable hone 52 is moved through tube 38 is chosen so as to achieve a sufficient decontamination factor (DF) where:

$$DF = \frac{\text{Initial Activity}}{\text{Final Activity}}$$

It has been found that it is important for rotatable hone 52 to rotate at between approximately 6–12 revolutions per inch of tube 38. At approximately 6–12 revolutions per inch of tube, a decontamination factor of between approximately 20–25 may be achieved. Thus, a decontamination factor of between 20–25 can be attained for various combinations of rotational speed and linear speed of rotatable hone 52. The following table illustrates some of the combinations that will yield approximately 6–12 revolutions per inch and thus yield decontaminations factors of between 20–25.

| Rotational Speed of hone (rpm) | Linear Speed of hone (ft/min) | Revolutions per inch of tube |
|---|---|---|
| 800 | 5 | 12 |
| 3500 | 25 | 12 |
| 800 | 10 | 6 |
| 3500 | 50 | 6 |

Therefore, decontaminations factors of approximately 20–25 can be achieved for rotational speeds of between 800–3500 rpm and for linear speeds of between 5 ft/min to 50 ft/min. The actual choice of rotational speeds and linear speeds may depend upon the time available to complete the operation.

Once a sufficient portion of tube 38 has thus been decontaminated, advancement mechanism 62 is reversed which causes rotatable hone 52 to be withdrawn from tube 38. As second flexible conduit 82 is withdrawn under the action of advancement mechanism 62, a second fluid which may also be water is introduced into spray chamber 102 through inlet port 108. The second fluid is sprayed against second flexible conduit 82 thereby washing contaminants therefrom and into spray water return chamber 110. From spray water return chamber 110, the second fluid is conducted through drain piping 100. As second flexible conduit is withdrawn, it also contacts buffing cloths 114 which wipe residual fluids and contaminants therefrom.

When rotatable hone 52 has thus been withdrawn from the selected tube 38, the same process may then be performed on another tube. Of course, several rotatable hones 52 may be arranged on a single attachment mechanism 54 so that several tubes 38 may be decontaminated at once. In this manner, tubes 38 are decontaminated thereby reducing the radiation level in primary fluid inlet plenum 34 and primary fluid outlet plenum 36 so that working personnel may enter and perform operations in steam generator 20. Therefore, it can be seen that the invention provides decontamination apparatus capable of remotely decontaminating tubes in a nuclear steam generator.

We claim as our invention:

1. Apparatus for decontaminating tubular members comprising:

a nozzle capable of being disposed in a tubular member and having a channel therein inclined at approximately 20°–40° from the longitudinal axis of said nozzle for spraying a fluid therefrom;

a helically wound tube attached to said nozzle for conducting said fluid to said nozzle;

an inner member connected to said helically wound tube and having a bore therethrough for conducting said fluid to said helically wound tube and having a passage therein for allowing said fluid to enter said bore;

an outer member disposed around said inner member for rotatably supporting said inner member; and a brush mounted on said helically wound tube and extending into contact with the inside surface of said tubular member for removing material from said tubular member when said brush is being rotated and while said fluid is being sprayed against said tubular member thereby decontaminating said tubular member.

2. The apparatus according to claim 1 wherein said apparatus further comprises:

a flexible conduit attached to said outer member for conducting said fluid to said inner member; and a cable disposed in said flexible conduit and attached to said inner member for rotating said inner member and said brush when said cable is rotated.

3. The apparatus according to claim 2 wherein said channel is inclined at approximately 30° from the longitudinal axis of said nozzle.

4. Apparatus for decontaminating tubular members comprising:

a hone capable of being disposed in said tubular members for removing material from said tubular members thereby decontaminating said tubular members;

a first flexible conduit capable of being attached to said tubular members for guiding said hone through said tubular members;

a second flexible conduit capable of being disposed in said first flexible conduit and attached to said hone for conducting a first fluid to said hone;

cleaning means attached to said first flexible conduit for collecting the contaminants removed by said hone and for removing contaminants from said hone; and advancement means capable of contacting said second flexible conduit for inserting and withdrawing said hone from said tubular members.

5. The apparatus according to claim 4 wherein said apparatus further comprises a cable disposed in said second flexible conduit and attached to said hone for rotating said hone.

6. The apparatus according to claim 5 wherein said apparatus further comprises drive means attached to said cable for rotating said hone.

7. The apparatus according to claim 6 wherein said apparatus further comprises cable holding means for storing said cable.

8. The apparatus according to claim 4 wherein said cleaning means comprises:

a housing capable of being attached to said first flexible conduit and having a central passage therethrough for allowing said second flexible conduit to be moved therethrough;

a first fluid return chamber defined within said housing for collecting said first fluid;

a spray chamber defined within said housing for spraying a second fluid onto said second flexible conduit for removing contaminants therefrom; and a wiper section defined within said housing for contacting said second flexible conduit thereby removing fluid and contaminants therefrom.

* * * * *